US012195892B2

(12) United States Patent
Salvetti

(10) Patent No.: US 12,195,892 B2
(45) Date of Patent: Jan. 14, 2025

(54) ASSEMBLED TEXTILE PRODUCTS

(71) Applicant: LONATI S.P.A., Brescia (IT)

(72) Inventor: Sergio Salvetti, Chiari (IT)

(73) Assignee: LONATI S.P.A., Brescia (IT)

( * ) Notice: Subject to any disclaimer, the term of this patent is extended or adjusted under 35 U.S.C. 154(b) by 162 days.

(21) Appl. No.: 17/314,749

(22) Filed: May 7, 2021

(65) Prior Publication Data

US 2021/0262129 A1 Aug. 26, 2021

Related U.S. Application Data

(63) Continuation of application No. 15/549,129, filed as application No. PCT/IB2016/050362 on Jan. 25, 2016, now Pat. No. 11,028,508.

(30) Foreign Application Priority Data

Feb. 6, 2015 (IT) ..... BS2015A000017

(51) Int. Cl.

| | |
|---|---|
| ***D04B 1/24*** | (2006.01) |
| ***A41H 42/00*** | (2006.01) |
| ***A41H 43/00*** | (2006.01) |
| ***A41H 43/04*** | (2006.01) |
| ***D04B 21/20*** | (2006.01) |
| ***D06C 5/00*** | (2006.01) |

(52) U.S. Cl.

CPC ..... *D04B 1/246* (2013.01); *A41H 43/005* (2013.01); *A41H 43/04* (2013.01); *D06C 5/005* (2013.01); *A41H 42/00* (2013.01); *D04B 21/207* (2013.01); *D06C 5/00* (2013.01)

(58) Field of Classification Search

CPC .... D04B 1/225; D04B 21/205; D04B 21/207; D06C 5/00; D06C 5/005

See application file for complete search history.

(56) References Cited

U.S. PATENT DOCUMENTS

| | | | |
|---|---|---|---|
| 3,726,745 | A | 4/1973 | Gidge et al. |
| 3,819,638 | A | 6/1974 | Ogawa et al. |

(Continued)

FOREIGN PATENT DOCUMENTS

| | | | |
|---|---|---|---|
| EP | 1286603 | B1 | 3/2003 |
| ES | 2247125 | T3 | 3/2006 |

(Continued)

OTHER PUBLICATIONS

Spencer, "Knitting Technology", CH 5 & CH 13, published by Elsevier copyright 1983 (Year: 1983).*

(Continued)

*Primary Examiner* — Jennifer A Steele

(74) *Attorney, Agent, or Firm* — MH2 TECHNOLOGY LAW GROUP LLP

(57) ABSTRACT

An assembled textile product includes a plurality of parts of fabric cut from one or more open pieces of fabric. At least one of the plurality of parts of fabric is cut from a tubular knitted fabric having a rest configuration and a stretched configuration. The tubular knitted fabric includes a heat adhesive material applied on at least a portion of a surface of the tubular knitted fabric in the stretched configuration so as to stabilize the first portion of the tubular knitted fabric by reducing its elasticity or deformability.

20 Claims, 2 Drawing Sheets

(56) References Cited

U.S. PATENT DOCUMENTS

| | | | | |
|---|---|---|---|---|
| 3,892,342 | A * | 7/1975 | Ogawa | D06C 5/005 223/57 |
| 4,111,009 | A | 9/1978 | Robinson et al. | |
| 4,841,748 | A | 6/1989 | Watanabe et al. | |
| 6,354,017 | B1 | 3/2002 | Bertoldo | |
| 2004/0123368 | A1* | 7/2004 | Bingham | A41H 42/00 156/229 |
| 2005/0115281 | A1 | 6/2005 | Mitchell et al. | |
| 2012/0255201 | A1 | 10/2012 | Little | |
| 2013/0333423 | A1 | 12/2013 | Lonati et al. | |
| 2016/0044980 | A1* | 2/2016 | Greenacre | A41D 1/06 2/243.1 |
| 2017/0143059 | A1 | 5/2017 | Gallagher | |

FOREIGN PATENT DOCUMENTS

| | | | |
|---|---|---|---|
| JP | 2008101304 | A | 5/2008 |
| JP | 2014231647 | A | 12/2014 |

OTHER PUBLICATIONS

Search Report dated Apr. 11, 2016 in counterpart International Application No. PCT/IB2016/050362, 3 pages.

International Preliminary Report on Patentability dated Aug. 8, 2017 in counterpart International Application No. PCT/IB2016/050362, 6 pages.

Spencer. "Knitting Technology," Ch. 5, 7, and 13, 1983, pp. 38-47, 60-81, and 146-160.

* cited by examiner

ASSEMBLED TEXTILE PRODUCTS

The present invention relates to a method for making assembled textile products, in particular jackets, trousers, men's suits, women's dresses or other textile products assembled from a plurality of fabric parts. The invention further relates to an assembled textile product obtained with this method. It is known about several types of assembled textile products, i.e. complex textile products made by suitably assembling a plurality of suitably shaped fabric parts. These fabric parts are obtained first of all by cutting one or more fabrics so as to make suitable shapes, e.g. by using paper patterns or cutting templates. The fabric parts thus cut are then assembled in a known manner so as to make the desired textile products. The fabrics used for making these assembled textile products must have specific properties, i.e. relating to stability and stiffness, so as to be able to be processed and to give the finished product the desired appearance and technical features. These fabrics include e.g. jersey, velvet, brocade etc. and are manufactured with materials including e.g. cotton, wool, linen, silk, synthetic materials etc. Traditionally, these fabrics are made by specialized manufacturers or weavers using rectilinear knitting machines such as e.g. looms, for manufacturing weft and warp fabric, generally having a high structural stiffness, or circular machines with large diameter, above 24 inches, typically of double needlebed type and configured for making several lengths of "structured" fabrics, having a sufficiently high structural stability and stiffness though being knitted fabrics, which are suitable for manufacturing large amounts of fabric.

Known processes for making assembled knitted products, in particular jackets, trousers, men's suits, women's dresses and the like, have some drawbacks. A first drawback consists in that the stability and stiffness properties of the fabrics traditionally used for making these products result in a corresponding stiffness of the assembled textile products, thus causing limitations as far as wearability of the textile products and users' coziness and comfort are concerned. A second drawback consists in the presence of limitations to the knitting possibilities offered by knitting machines traditionally used for making these fabrics, manufactured in very long pieces, which allow to make some types of wefts and patterns though not offering a high flexibility as far as fabric type or fineness is concerned, and not allowing to make automatically complex knitted partners onto the fabric, which could however be made with other types of knitting machines. A third drawback relates to manufacturing times for traditional fabrics, which are quite long. A fourth drawback consists in the low flexibility of manufacturing processes for these fabrics, since usually these knitting machines require a complex initial setup and are configured for manufacturing necessarily large amounts of fabric so that production can be cheap. However, this results in high limitations as far as the flexibility of the manufacturing process of the knitted products is concerned, and makes the production of samples and small on-demand amounts highly expensive.

The technical aim of the present invention is to obviate one or more of the drawbacks mentioned above. A further aim of the invention is to provide a method that allows to manufacture assembled textile products, in particular jackets, trousers, men's suits, women's dresses or other textile products assembled from a plurality of fabric parts, having a high wearability, i.e. a high capacity to fit the shapes of each user. Another aim of the invention is to provide a method that allows to make assembled textile products having a high comfort of use for users. Another aim of the invention is to provide a method that allows to make assembled textile products having a high degree of elasticity, even without using elastic yarns. Another aim of the invention is to provide a method that allows to make assembled textile products having a large variety of textile effects and knitted structures. Another aim of the invention is to provide a method that allows to make assembled textile products with a high quality and low cost. Another aim of the invention is to provide a method that allows to make assembled textile products for small productions and samplings, rapidly and with low costs. Another aim of the invention is to provide a method that allows to make assembled textile products with a high manufacturing flexibility. Another aim of the invention is to provide a method for making assembled textile products that allows to reduce the need for manual interventions by operators for making these products.

These and other aims, which shall appear better from the following description, are basically achieved by a method and by a textile product according to the appended claims, considered alone or in mutual combination and/or with one or more of the aspects referred to below. Further aspects of the invention are disclosed below, which can be considered alone or in any combination with the claims, including also claim 10 relating to an assembled textile product, and/or in mutual combination.

In one aspect, the invention relates to a method for making assembled textile products comprising the following steps: manufacturing a tubular knitted fabric by means of a circular knitting machine for hosiery or by means of a knitting machine for knitwear; pulling the tubular fabric produced by the knitting machine onto a support so as to stretch the tubular fabric; applying a heat adhesive material onto at least a first portion of an outer surface of the tubular fabric pulled over the support, and letting the heat adhesive material firmly adhere onto the tubular fabric; cutting the tubular fabric onto which the heat adhesive material has been applied, so as to obtain an open piece of fabric; cutting the open piece of fabric according to predefined cutting lines for obtaining one or more parts of a textile product to be assembled; assembling a plurality of parts obtained from the open piece of fabric or from a plurality of pieces of fabric for obtaining a textile product, preferably an assembled textile product, e.g. a jacket, a pair of trousers, a men's suit, a women's dress or other textile products assembled from a plurality of parts.

In another aspect, the invention relates to a method for arranging an open piece of fabric designed to make assembled textile products, in particular jackets, trousers, men's suits, women's dresses or other textile products assembled from a plurality of fabric parts, the method comprising the following steps:

- arranging a tubular knitted fabric produced by means of a circular knitting machine for hosiery or by means of a knitting machine for knitwear, or as an alternative manufacturing the tubular knitted fabric by means of a circular knitting machine for hosiery or by means of a knitting machine for knitwear;
- pulling the tubular fabric produced by the knitting machine onto a support so as to stretch the tubular fabric with a predefined tensioning degree of the fabric, so that at least part of the inner surface of the tubular fabric contacts the support and an outer surface of the tubular fabric is still accessible;
- applying a heat adhesive material onto at least a first portion of an outer surface of the tubular fabric pulled over the support, and letting the heat adhesive material firmly adhere under heat onto the tubular fabric so as to stabilize the first portion of fabric reducing its elasticity and/or deformability;

cutting the tubular fabric onto which the heat adhesive material has been applied, so as to obtain an open piece of fabric.

In a further aspect, the invention relates to a method for making assembled textile products, in particular jackets, trousers, men's suits, women's dresses or other textile products assembled from a plurality of fabric parts, comprising the following steps:

arranging an open piece of fabric made according to the preceding aspect;

cutting the open piece of fabric according to predefined cutting lines for obtaining one or more parts of a textile product to be assembled;

assembling a plurality of parts obtained from said open piece of fabric or from a plurality of pieces of fabric for obtaining an assembled textile product, in particular a jacket, a pair of trousers, a men's suit, a women's dress or other textile products assembled from a plurality of parts.

In a further aspect, the invention relates to a method for making assembled textile products, in particular jackets, trousers, men's suits, women's dresses or other textile products assembled from a plurality of fabric parts, comprising the following steps:

arranging several parts of a textile product to be assembled, each part being made by cutting along predefined cutting lines a portion of an open piece of fabric, said piece of fabric being made in its turn by producing a tubular knitted fabric by means of a circular knitting machine for hosiery or by means of a circular knitting machine for knitwear, by pulling the tubular fabric produced by the knitting machine over a support so as to stretch the tubular fabric, by applying a heat adhesive material onto at least a first portion of an outer surface of the tubular fabric pulled over the support letting the heat adhesive material firmly adhere onto the tubular fabric, and by cutting the tubular fabric onto which the heat adhesive material has been applied, so as to obtain an open piece of fabric;

assembling said several parts for obtaining an assembled textile product, in particular a jacket, a pair of trousers, a men's suit, a women's dress or other textile products assembled from a plurality of parts.

In one aspect, said several parts of a textile product (preferably according to the preceding aspect) can be obtained from a single open piece of fabric or from a plurality of pieces of fabric that are distinct and/or different as far as type and features are concerned.

According to other aspects, the invention further relates to a method for making textile products, wherein: —the step of arranging the open piece of fabric is carried out by obtaining this piece already made, e.g. by purchasing it from an external manufacturer;

the step of arranging a tubular knitted fabric is carried out by obtaining this tubular fabric already made, e.g. by purchasing it from an external manufacturer;

the whole outer surface of the tubular fabric, or most of the outer surface of the tubular fabric, is coated with the heat adhesive material and the heat adhesive material is heated and then cooled or let cool down so as to stabilize the whole tubular fabric coated with the material;

the tubular fabric is of jersey type;

the tubular fabric is of jacquard type;

the tubular fabric comprises at least one jacquard portion obtained by a technique with yarn finished with a trimming knife;

the heat adhesive material to be applied onto the tubular fabric is mated with a weft-warp coating fabric;

the heat adhesive material to be applied onto the tubular fabric is mated with a knitted coating fabric;

the heat adhesive material to be applied onto the tubular fabric is mated with a coating fabric with a higher stiffness than the tubular fabric;

the heat adhesive material is in the form of a coating membrane;

the step of heating the heat adhesive material applied onto the tubular fabric is carried out by heating at least one pressure element at least partially matching the shape of the support and by pressing the heat adhesive material onto the tubular fabric by means of this pressure element;

the first portion of the outer surface of the tubular fabric develops longitudinally along the tubular item;

the first portion of the outer surface of the tubular fabric comprises at least one generatrix of the cylinder corresponding to the tubular fabric;

the tubular fabric is turned inside out before being pulled over the support and the heat adhesive material is applied onto the surface corresponding to the reverse or inner side of the tubular fabric produced by the knitting machine;

it further comprises the step of removing the tubular fabric, or the open piece of fabric, from the support;

the step of cutting the tubular fabric is carried out manually;

the step of cutting the tubular fabric is carried out automatically and/or by means of a suitable automatic cutting device;

the step of cutting the tubular fabric onto which the heat adhesive material has been applied so as to obtain an open piece of fabric is carried out before the step of removing the tubular fabric from the support;

the step of cutting the tubular fabric onto which the heat adhesive material has been applied so as to obtain an open piece of fabric is carried out after the step of removing the tubular fabric from the support;

the step of cutting the tubular fabric onto which the heat adhesive material has been applied so as to obtain an open piece of fabric is carried out by cutting the fabric along a generatrix of the cylinder corresponding to the tubular fabric;

the step of cutting the tubular fabric onto which the heat adhesive material has been applied so as to obtain an open piece of fabric is carried out by cutting the fabric at least on the first portion of the outer surface of the tubular fabric coated with the heat adhesive material;

the step of cutting the open piece of fabric according to predefined cutting lines for obtaining one or more parts of a textile product to be assembled is carried out by using paper patterns or cutting templates;

the step of producing a tubular knitted fabric by means of a circular knitting machine for hosiery or by means of a knitting machine for knitwear further comprises the step of automatically making onto the tubular fabric at least one pocket and/or at least one flounce and/or at least one relief and/or at least one portion of a terrycloth fabric and/or at least one portion of fabric having a variable fabric thickness and/or at least one multicolored portion of fabric made by using a plurality of yarns with different colors;

the step of producing a tubular knitted fabric by means of a circular knitting machine for hosiery or by means of a knitting machine for knitwear further comprises the step of automatically making onto the tubular fabric at least one portion of jacquard fabric and/or a jacquard pattern made with a technique with yarn finished with a trimming knife;

the step of applying a heat adhesive material onto an outer surface of the tubular fabric pulled over the support is carried out by spreading the heat adhesive material onto the tubular fabric;

the step of applying a heat adhesive material onto an outer surface of the tubular fabric pulled over the support is carried out by spraying the heat adhesive material onto the tubular fabric; —the step of applying a heat adhesive material onto an outer surface of the tubular fabric pulled over the support and the step of heating the heat adhesive material applied onto the tubular fabric are carried out by heating and spraying the heat adhesive material onto the tubular fabric;

the step of applying a heat adhesive material onto an outer surface of the tubular fabric pulled over the support is carried out by dipping the tubular fabric into the heat adhesive material;

the step of applying a heat adhesive material onto an outer surface of the tubular fabric pulled over the support and the step of heating the heat adhesive material applied onto the tubular fabric are carried out by dipping the tubular fabric into the heat adhesive material thus heated;

the step of assembling a plurality of parts obtained from the open piece of fabric or from a plurality of pieces of fabric for making an assembled textile product is carried out by placing the surface coated with the heat adhesive material on the inner side of the assembled textile product;

the method further comprises the step of applying an additional coating fabric onto the tubular fabric on the outer surface coated with the heated heat adhesive material, so as to obtain a double fabric defined by the tubular fabric and by the additional fabric joined together by means of the heat adhesive material placed between them;

the method further comprises the step of printing a predefined pattern onto the surface of the fabric coated with the heat adhesive material or onto the coating fabric;

the tubular fabric is made with a single needlebed of the knitting machine;

the tubular fabric is made with a double needlebed of the knitting machine; —the tubular fabric is made with a double needle cylinder of the knitting machine;

the method is used for making textile products such as ties, scarves, sweaters, skirts, etc.;

the circular knitting machine is of the type not having a large diameter;

the circular knitting machine has a diameter of 3.5 to 22 inches;

the circular knitting machine has a diameter of 5 to 13 inches;

the circular knitting machine is of hosiery type and has a diameter of 3.5 to 6 inches;

the circular knitting machine has a fineness of 10 to 28 needles per inch;

the circular knitting machine is of "body size" knitwear type and/or has a diameter of 10 to 22 inches;

the circular knitting machine is configured for making weft knitted fabric;

the circular knitting machine is a seamless knitting machine;

the circular knitting machine is with a single needlebed;

the circular knitting machine is with a double needlebed;

the circular knitting machine is with a double needle cylinder;

the circular knitting machine is configured for making onto the tubular fabric at least one portion of terrycloth fabric.

In another aspect, the invention further relates to a product obtained by a method according to any one of the appended claims. In another aspect, the invention further relates to a textile product comprising a plurality of parts of fabric cut from one or more open pieces of fabric, wherein at least one of such parts of fabric consists of a portion of tubular knitted fabric made by means of a circular knitting machine for hosiery or by means of a knitting machine for knitwear and having a heat adhesive material applied under heat onto at least one portion of a surface of the fabric so as to stabilize the fabric itself.

According to other aspects, which can be combined with the claims or with other aspects, the invention further relates to a textile product, wherein:

a plurality of parts of fabric of the textile product consists of portions of tubular knitted fabric made by means of a circular knitting machine for hosiery or by means of a knitting machine for knitwear and having a heat adhesive material applied, preferably under heat, onto at least one portion of a surface of the fabric;

the part of fabric or the parts of fabric made by means of a circular knitting machine for hosiery or by means of a knitting machine for knitwear are provided with a heat adhesive material applied, preferably under heat, onto a whole surface of the fabric or onto most of a surface of the fabric;

the heat adhesive material is applied onto an inner side of the assembled textile product.

Further characteristics and advantages shall be more evident from the detailed description of one or more preferred embodiments, which are exemplary though not exclusive, according to the accompanying figures, in which.

Figure 1:
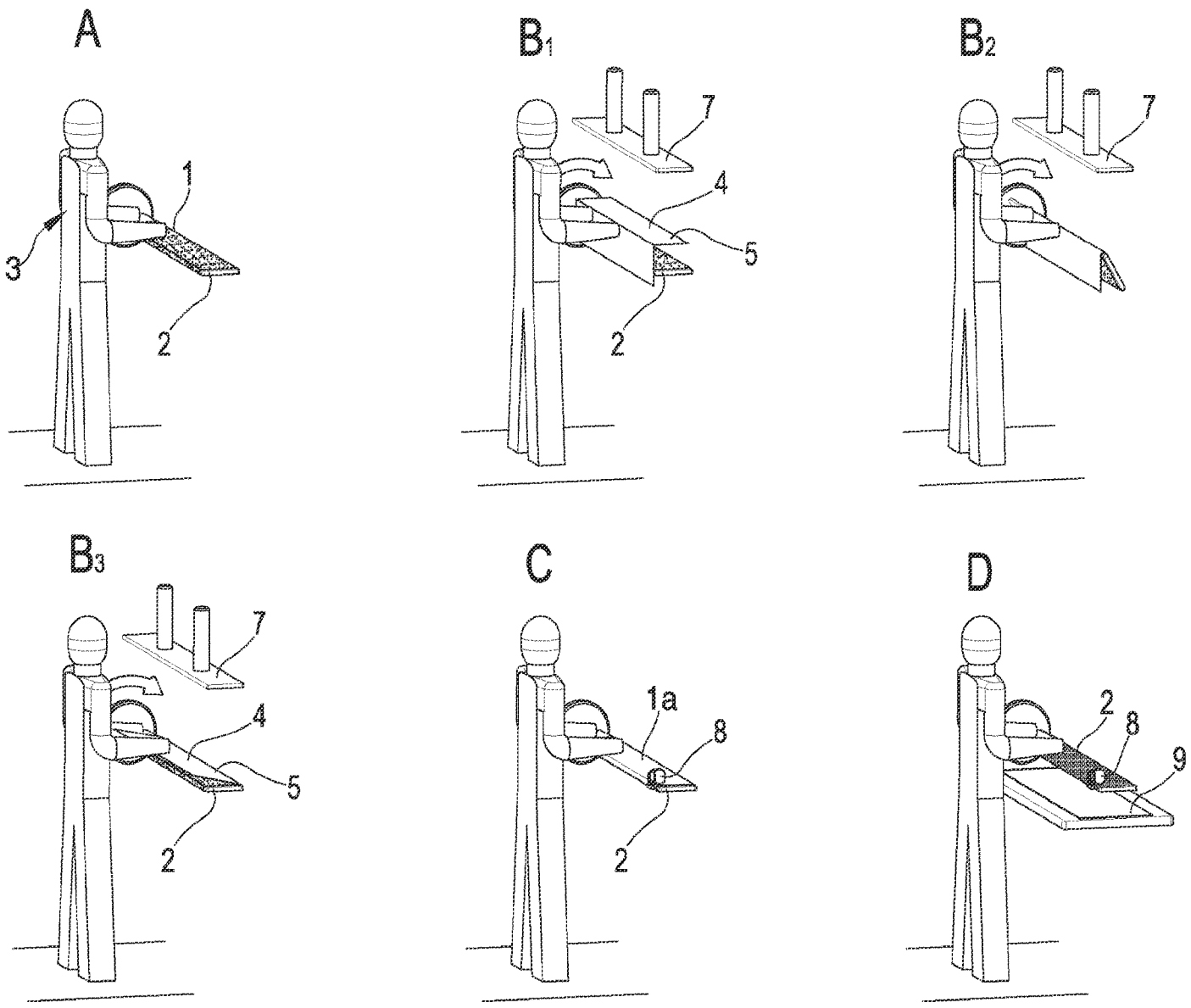
FIG. 1 shows a first embodiment of the invention, in which a tubular fabric is pulled over a basically flat-shaped support for executing further operations on the fabric.

The figures mentioned above show some steps of the method according to corresponding embodiments of the invention, shown with reference to two respective embodiments of machines designed for executing these steps. A method according to the invention allows in particular to make jackets, trousers, men's suits, women's dresses or other textile products assembled from a plurality of fabric parts.

First of all, the method comprises the step of producing a tubular knitted fabric by means of a circular knitting machine for hosiery or by means of a knitting machine for knitwear. The fabric is preferably of weft knitted type. The fabric is preferably made by means of a single needlebed of the knitting machine, though in a variant it can be made by means of two needlebeds, in particular two needle cylinders. The circular knitting machine preferably has a diameter of 3.5 to 22 inches. The circular knitting machine preferably has a diameter of 5 to 13 inches. The circular knitting machine preferably has a fineness of 10 to 28 needles per inch. The circular knitting machine is preferably of single needlebed type. In a variant it can be of double needlebed or double cylinder type. In a variant, the step of producing a tubular knitted fabric can further comprise the step of automatically making onto the tubular fabric at least one pocket and/or at least one flounce and/or at least one relief and/or at least one portion of a terrycloth fabric and/or at least one portion of fabric having a variable fabric thickness.

The method can further comprise, during the step of producing a tubular knitted fabric, the step of making onto the tubular fabric at least a row of differentiated fabric developing along a generatrix of the cylinder corresponding to the tubular fabric, so as to define a reference line for correctly positioning later the tubular fabric on a support and/or for later guiding a cut of the tubular fabric along this reference line.

The method further comprises the step of pulling the tubular fabric 1 produced by the knitting machine onto a support 2 so as to stretch the tubular fabric 1 with a predefined tensioning degree of the fabric, so that at least part of the inner surface of the tubular fabric 1 contacts the support 2 and an outer surface of the tubular fabric 1 is still accessible. The size of the support is determined with respect to the size of the tubular fabric to be loaded onto the support itself. A plurality of supports can be provided, each of them being suitable for a specific size interval of the tubular fabric. This step is referred to in the two embodiments of FIG. 1 and FIG. 2 with letter A and can be carried out e.g. by an operator 3, as shown. The predefined tensioning degree is determined so as to enable a complete, uniform fabric stretching, thus avoiding wrinkles or folds, and can further be selected so as to determine the stretching degree and/or the appearance of the fabric resulting from the method, according to the characteristics desired for the fabric of the textile product to be made. The support 2 can be heated so as to enable a first stretching of the fabric pulled over the support, shown as step E in FIG. 2. The method further comprises the step of applying a heat adhesive material 4 onto at least a first portion of an outer surface of the tubular fabric 1 pulled over the support 2, and letting the heat adhesive material 4 firmly adhere under heat onto the tubular fabric 1 so as to stabilize the first portion of fabric reducing its elasticity and/or deformability, as a result of the later cooling of the heat adhesive material. The wording "under heat" refers to a sufficiently high temperature to enable the activation of the adhesive properties of the heat adhesive material. This step is referred to as step B1, B2 and B3 in FIG. 1 and as step B in FIG. 2. Thus, a tubular fabric 1*a* coated with heat adhesive material 4 is made. Preferably, the first portion of the outer surface of the tubular fabric 1 develops longitudinally along the tubular item and/or comprises at least one generatrix of the cylinder corresponding to the tubular fabric 1. Preferably, the tubular fabric 1 is turned inside out before being pulled over the support 2 and the heat adhesive material 4 is applied onto the surface corresponding to the reverse or inner side of the tubular fabric 1 produced by the knitting machine. In a preferred embodiment, the step of applying a heat adhesive material 4 onto an outer surface of the tubular fabric 1 pulled over the support 2 is carried out by coating the whole outer surface of the tubular fabric 1 and by stabilizing the whole tubular fabric 1 or coating most of the tubular fabric 1.

In a preferred embodiment, the heat adhesive material 4 is shaped as a sheet 5 or applied onto a supporting sheet 5, and the step of applying the heat adhesive material 4 onto an outer surface of the tubular fabric 1 pulled over the support 2 is carried out by placing a sheet 5 of heat adhesive material 4 or a sheet 5 containing the heat adhesive material 4 beside the tubular fabric 1 and contacting them. For instance, in FIG. 2 step B shows the application of a sheet 5 of heat adhesive material 4 being unwound from a feeding roll 6 onto the tubular fabric 1 applied onto the support 2, by means of a pressure roll 7. In a variant, the step of applying a heat adhesive material 4 onto an outer surface of the tubular fabric 1 pulled over the support 2 can be carried out by spraying or spreading the heat adhesive material 4, e.g. already heated or to be heated later, onto the tubular fabric 1. In another variant, the step of applying a heat adhesive material 4 onto an outer surface of the tubular fabric 1 pulled over the support 2 can be carried out by dipping the tubular fabric 1 into the heat adhesive material 4. In a variant, the method can further comprise the step of heating the heat adhesive material 4 applied onto the tubular fabric 1 so as to let the heat adhesive material 4 permanently adhere to the tubular fabric 1. The method can further comprise the step of cooling the heat adhesive material 4 heated and applied onto the tubular fabric 1 or letting it cool down. In a variant, the method comprises the step of heating the heat adhesive material 4 before applying the heat adhesive material 4 onto the tubular fabric 1. In a preferred embodiment, the method comprises the step of heating the heat adhesive material 4 applied onto the tubular fabric 1 so as to let the heat adhesive material 4 permanently adhere to the tubular fabric 1 by heating the support 2 over which the tubular fabric 1 is pulled. In a variant, the method comprises the step of heating the heat adhesive material 4 applied onto the tubular fabric 1 by mating the support 2 with a heated element or a heated plate or a heated roll with the support 2 for a predefined time. This step can be carried out by means of at least one pressure element 7 at least partially matching the shape of the support 2 and by pressing the heat adhesive material 4 onto the tubular fabric 1 by means of this pressure element 7. In a preferred embodiment, the method further comprises the step of pressing the heat adhesive material 4 onto the tubular fabric 1 at least during or after a step of heating the heat adhesive material 4. In a preferred embodiment, the method further comprises the step of mating the support 2 over which the tubular fabric 1 is pulled with at least one pressure element 7 at least partially matching the shape of the support 2, so as to press the heat adhesive material 4 onto the tubular fabric 1 at least during or after a step of heating the heat adhesive material 4, so as to cause a suitable, uniform adhesion of the heat adhesive material 4 to the tubular fabric 1. In the embodiment shown in FIG. 1, the support 2 is a template or textile form having a basically flat shape. In this case the pressure element 7, apt to press the heat adhesive material 4 onto the tubular fabric 1 at least during or after the step of heating the heat adhesive material 4, can be a pressure plate at least partially matching the shape of the support 2. In a variant, two pressure elements can be provided, consisting of pressure plates.

Figure 2:
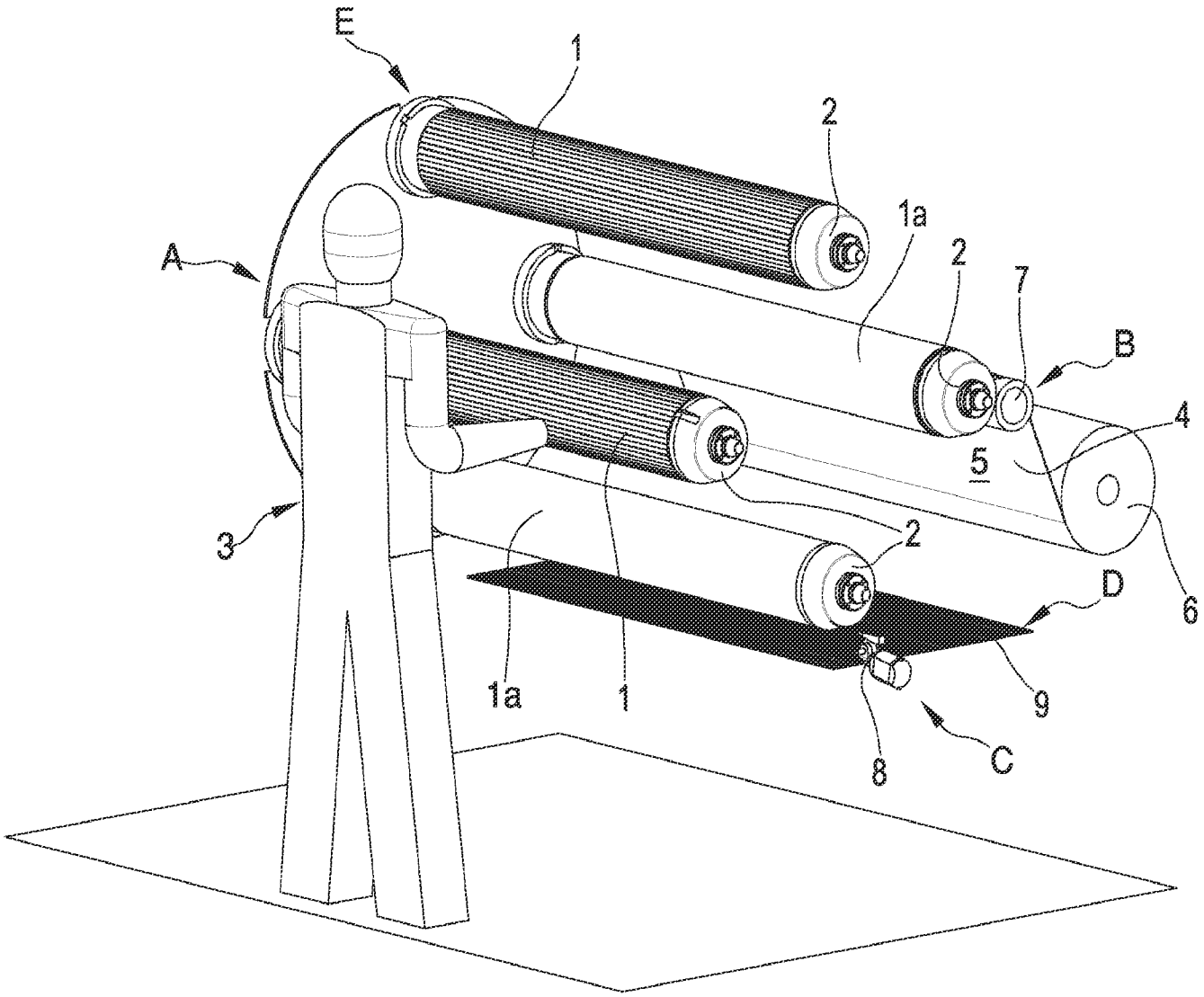
FIG. 2 shows a second embodiment of the invention, in which a tubular fabric is pulled over a roll-shaped support for executing further operations on the fabric.

In the embodiment shown in FIG. 2, the support 2 is a supporting roll or a tubular supporting element. In this case the pressure element 7, apt to press the heat adhesive material 4 onto the tubular fabric 1 at least during or after the step of heating the heat adhesive material 4, is preferably a pressure roll 7. In a variant, two pressure elements can be provided, consisting of pressure rolls. Preferably, the support 2 is turnable. In the embodiment of FIG. 1, the operator 3 can turn this support 2 so as to be able to readily apply the heat adhesive material 4 to both sides, the upper and the lower side, of the tubular fabric 1.

In the embodiment of FIG. 2, the support 2 can turn so as to enable the tubular fabric 1 to be mated with the sheet 5 of heat adhesive material 4 unwound from the feeding roll 6. The method further comprises the step of cutting the tubular fabric 1 onto which the heat adhesive material 4 has been applied, so as to obtain an open piece 9 of fabric. This step of cutting the tubular fabric 1 can be carried out before a step of removing the tubular fabric 1 from the support 2. As an alternative, this step of cutting the tubular fabric 1 onto which the heat adhesive material 4 has been applied so as to obtain an open piece 9 of fabric can be carried out after the step of removing the tubular fabric 1 from the support 2. Preferably, the step of cutting the tubular fabric 1 onto which the heat adhesive material 4 has been applied so as to obtain an open piece 9 of fabric is carried out by cutting the fabric along a generatrix of the cylinder corresponding to the tubular fabric 1 and/or on the first portion of the outer surface of the tubular fabric 1 coated with the heat adhesive material 4. The step of cutting the tubular fabric 1 is shown in a schematic manner as step C in FIGS. 1 and 2, in which also a cutting element 8 is represented. In a variant, the method can further comprise the step of applying an additional coating fabric onto the tubular fabric 1 on the outer surface coated with the heated heat adhesive material 4, so as to obtain a double fabric defined by the tubular fabric 1 and by the additional fabric joined together by means of the heat adhesive material 4. The method further comprises the step of removing the fabric from the support 2 and of stretching the open piece 9 of fabric. This step is shown in FIGS. 1 and 2 as step D.

The steps shown in FIG. 1 will now be described in further detail:

- step A: the operator loads the tubular fabric onto the support;
- step B1: the operator applies a portion of sheet of heat adhesive material onto an upper side of the tubular fabric on the support, and the sheet is then pressed by means of the heated pressure element 7, so as to let the heat adhesive material adhere to the upper side of the tubular fabric;
- step B2: the operator turns the support for positioning the lower side of the tubular fabric upwards;
- step B3: the operator applies the remaining portion of the sheet of heat adhesive material onto the lower side, now positioned upwards, of the tubular fabric, by means of the heated pressure element 7;
- step C: the operator cuts the tubular fabric by means of a cutting element 8 on a predefined cutting line;
- step D: the operator removes from the support the open piece of fabric by cutting the tubular fabric and lays it onto a resting plane, from which it will then be moved to the following processing stations.

In another variant, the method can further comprise the step of printing a predefined pattern onto the surface of the fabric coated with the heat adhesive material 4. The method further comprises the step of cutting the open piece 9 of fabric according to predefined cutting lines for obtaining one or more parts of a textile product to be assembled. Preferably, the step of cutting the open piece 9 of fabric according to predefined cutting lines for obtaining one or more parts of a textile product to be assembled is carried out by using paper patterns or cutting templates. For instance, these paper patterns can be configured for defining a plurality of parts of a men's jacket. By choosing a suitable size of the diameter of the cylinder of the knitting machine it is possible to obtain open pieces of fabric having suitable sizes with respect to the paper patterns or cutting templates to be used, so as to minimize fabric waste. Thanks to the use of a plurality of knitting machines with suitable diameters it is possible to obtain a plurality of pieces of fabric suitable for respective paper patterns or cutting templates. In a preferred embodiment, the part or parts of a textile product to be assembled, obtained from the open piece 9 of fabric resulting from the cut tubular fabric 1, are wholly made up on their whole length of fabric mated with heat adhesive material 4 on a surface of the fabric. The method further comprises the step of assembling a plurality of parts obtained from said open piece 9 of fabric or from a plurality of pieces 9 of fabric for obtaining an assembled textile product, in particular a jacket, a pair of trousers, a men's suit, a women's dress or other textile products assembled from a plurality of parts. Preferably, the step of assembling a plurality of parts obtained from the open piece 9 of fabric or from a plurality of pieces 9 of fabric for making an assembled textile product is carried out by placing the surface coated with the heat adhesive material 4 on the inner side of the textile product. The method can further enable to make ties, scarves, sweaters, skirts, etc.

The invention further relates to an assembled textile product, in particular a jacket, a pair of trousers, a men's suit, a women's dress or another textile product assembled from a plurality of parts of fabric, comprising a plurality of parts of fabric cut from one or more open pieces 9 of fabric, wherein at least one of such parts of fabric consists of a portion of knitted tubular fabric 1 made by means of a circular knitting machine for hosiery or by means of a knitting machine for knitwear and having a heat adhesive material 4 applied under heat onto at least one portion of a surface of the fabric. In a preferred embodiment, a plurality of parts of fabric of the textile product consists of portions of tubular knitted fabric 1 made by means of a circular knitting machine for hosiery or by means of a knitting machine for knitwear and having a heat adhesive material 4 applied under heat onto at least one portion of a surface of the fabric. In a preferred embodiment, the part of fabric or the parts of fabric made by means of a circular knitting machine for hosiery or by means of a knitting machine for knitwear are provided with a heat adhesive material 4 applied under heat onto a whole surface of the fabric or onto most of the surface of the fabric. In a preferred embodiment, the heat adhesive material 4 is applied onto an inner side of the assembled textile product.

The invention can be used for making various types of textile products, such as e.g.: jackets, trousers, men's suits, women's dresses, scarves, ties, skirts, underwear, lingerie, knitwear, technical items, sports items, medical items, other textile products assembled from a plurality of fabric parts. The invention achieves important advantages. First of all, the invention allows to overcome one or more of the drawbacks of known technique. The invention further allows to produce assembled textile products having a high wearability, i.e. a high ability to fit the shapes of each user, and a high comfort of use for users. The invention further allows to produce assembled textile products having a degree of elasticity, either mono- or bidirectional, that can be also obtained without using elastic yarns and that can be easily configured according to the needs of the specific textile product. The invention further allows to make assembled textile products having a large variety of textile effects and knitted structures. The invention further allows to obtain assembled textile products with a high quality and low cost. The invention further allows to obtain textile products assembled from fabrics that can also be made specifically for small productions or samplings, without necessarily producing large amounts of fabric. The invention further allows to obtain assembled textile products in short times and with a high manufacturing flexibility. The invention further allows to reduce the need for manual interventions by operators for making assembled textile products.

What is claimed is:

1. An assembled textile product, comprising:

a plurality of parts of fabric comprising a fabric cut from one or more open pieces of fabric;

wherein at least one of the plurality of parts of fabric comprises a fabric portion cut from an open piece of a tubular knitted fabric;

wherein the tubular knitted fabric has a rest configuration and a stretched configuration made by stretching the tubular knitted fabric on a support and applying an adhesive material and heat to;

at least a portion of a surface of the tubular knitted fabric while in the stretched configuration so as to stabilize the portion of the tubular knitted fabric by reducing elasticity or deformability of the stabilized portion;

wherein the tubular knitted fabric is cut to form the open piece of tubular knitted fabric, and the fabric portion is cut from the open piece of tubular knitted fabric;

wherein a whole length of the fabric portion wholly comprises the stabilized portion of tubular knitted fabric fabric mated with adhesive material and wherein the tubular knitted fabric is a weft knitted fabric.

2. The textile product according to claim 1, wherein the textile product is a jacket, a pair of trousers, a men's suit, or a women's dress.

3. The textile product according to claim 1, further comprising an additional fabric applied onto the surface of the tubular knitted fabric that is coated with the heated heat adhesive material, so as to obtain a double fabric defined by the tubular knitted fabric and by the additional fabric joined together by means of the heat adhesive material placed between them.

4. The textile product according to claim 1, further comprising a predefined pattern printed onto the surface of the tubular knitted fabric coated with the heat adhesive material.

5. An assembled textile product assembled from a plurality of parts of fabric, comprising: a plurality of parts of fabric cut from one or more open pieces of fabric;

wherein a plurality of the plurality of parts of fabric respective portions cut from an open piece of a knitted tubular fabric made by means of a circular knitting machine for hosiery or by means of knitting machine for knitwear;

wherein said knitted tubular fabric is made by stretching the knitted tubular fabric on a support and applying an adhesive material and heat onto at least one portion of a surface of the fabric while in a stretched configuration so as to stabilize the fabric itself;

wherein the tubular knitted fabric is cut to form the one or more open pieces of tubular knitted fabric, and the plurality of the plurality of parts of fabric are cut from the open piece of tubular knitted fabric; and wherein the plurality of the plurality of parts of fabric are provided with a heat adhesive material applied onto a whole surface of the fabric.

6. The textile product according to claim 5, wherein the heat adhesive material is applied onto an inner side of the assembled textile product.

7. The textile product according to claim 5, wherein the heat adhesive material (4) is shaped as a sheet (5) or as a membrane, and wherein the heat adhesive material (4) is applied onto an outer surface of the tubular fabric (1) by placing the sheet (5) of heat adhesive material (4) or the membrane beside the tubular fabric (1) and contacting them, so as to obtain a tubular fabric coated with the heat adhesive material (4) only.

8. The textile product according to claim 5, wherein the heat adhesive material is shaped as a sheet (5) and is mated with an additional fabric, and wherein the heat adhesive material (4) is applied onto an outer surface of the tubular fabric (1) by placing the sheet (5) of heat adhesive material (4) and the additional fabric beside the tubular fabric (1) and contacting them, so as to obtain a tubular fabric coated with the additional fabric and firmly mated with the additional fabric by means of the heat adhesive material.

9. The textile product according to claim 5, wherein the part or parts of a textile product to be assembled, obtained from the open piece (9) of fabric, obtained from the tubular fabric (1), are wholly made over their extension of fabric mated with heat adhesive material (4) on a surface of the fabric.

10. The textile product according to claim 5, wherein said several parts of a textile product can be obtained from a single open piece of fabric or from a plurality of pieces of fabric that are distinct and/or different as far as type and features are concerned.

11. The textile product according to claim 5, wherein:

the tubular fabric is of jersey type; or the tubular fabric is of jacquard type; or the tubular fabric comprises at least one jacquard portion obtained by a technique with yarn finished with a trimming knife.

12. The textile product according to claim 5, wherein:

the heat adhesive material to be applied onto the tubular fabric is mated with a weft-warp coating fabric; or the heat adhesive material to be applied onto the tubular fabric is mated with a knitted coating fabric; and/or the heat adhesive material to be applied onto the tubular fabric is mated with a coating fabric with a higher stiffness than the tubular fabric; and/or the heat adhesive material is in the form of a coating membrane.

13. The textile product according to claim 5, wherein the tubular fabric comprises at least one pocket and/or at least one flounce and/or at least one relief and/or at least one portion of a terrycloth fabric and/or at least one portion of fabric having a variable fabric thickness and/or at least one multicolored portion of fabric made by using a plurality of yarns with different colors.

14. The textile product according to claim 5, wherein the part or parts of a textile product to be assembled, obtained from the open piece of fabric resulting from the cut tubular fabric, are wholly made up on their whole length of fabric mated with heat adhesive material on a surface of the fabric.

15. The textile product according to claim 5, further comprising an additional fabric applied onto the outer surface of the tubular fabric coated with the heated heat adhesive material, so as to obtain a double fabric defined by the tubular fabric and by the additional fabric joined together by means of the heat adhesive material placed between them.

16. The textile product according to claim 5, further comprising a predefined pattern printed onto the surface of the fabric coated with the heat adhesive material or onto the coating fabric.

17. A textile product, comprising:

a plurality of open piece fabric parts of fabric that are configured to be assembled together to form the textile product;

wherein at least one of the plurality of open piece fabric parts comprises a stabilized open piece fabric part cut from a stabilized tubular knitted fabric having reducing elasticity or deformability;

wherein the stabilized tubular knitted fabric comprises a tubular knitted fabric having a stretched configuration made by stretching a tubular knitted fabric on a support and applying adhesive material and heat to at least a portion of a surface of the tubular knitted fabric in the stretched configuration so as to stabilize the portion of the tubular knitted fabric by reducing elasticity or deformability of the stabilized portion;

wherein the stabilized tubular knitted fabric is cut to form the open piece of tubular knitted fabric, and the stabilized open piece fabric part is cut from the open piece of stabilized tubular knitted fabric;

wherein the tubular knitted fabric is a weft knitted fabric; and wherein a whole length of the stabilized open piece fabric part wholly comprises the stabilized portion of tubular knitted fabric mated with adhesive material.

18. The textile product according to claim 17, wherein the textile product is a jacket, a pair of trousers, a men's suit, or a women's dress.

19. The textile product according to claim 17, further comprising an additional coating fabric applied onto the tubular knitted fabric on the surface coated with the heated heat adhesive material, so as to obtain a double fabric defined by the tubular knitted fabric and by the additional fabric joined together by means of the heat adhesive material placed between them.

20. The textile product according to claim 17, further comprising a predefined pattern printed onto the surface of the tubular knitted fabric coated with the heat adhesive material.

* * * * *